US005984717A

United States Patent [19]

Lee

[11] Patent Number: 5,984,717

[45] **Date of Patent: *Nov. 16, 1999**

[54] ELECTRICAL CABLE INCLUDING STACKABLE COUPLERS

[75] Inventor: Noel Lee, Dallas, Tex.

[73] Assignee: Monster Cable Products, Inc., Brisbane, Calif.

[ * ] Notice: This patent is subject to a terminal disclaimer.

[21] Appl. No.: 08/803,494

[22] Filed: Feb. 20, 1997

[51] Int. Cl.[6] ..... H01R 13/72

[52] U.S. Cl. ..... 439/501; 439/502

[58] Field of Search ..... 439/501, 502, 439/623, 717, 594, 701, 604, 606, 588, 589; 174/135, 65 R, 71, 72

[56] References Cited

U.S. PATENT DOCUMENTS

| | | | |
|---|---|---|---|
| D. 387,733 | 12/1997 | Lee | D13/147 |
| D. 392,942 | 3/1998 | Lee | D13/147 |
| 4,469,393 | 9/1984 | Chewning, Jr. et al. | 439/717 |
| 4,564,732 | 1/1986 | Lancaster | 200/307 |
| 5,295,870 | 3/1994 | Rei et al. | 439/717 |
| 5,322,972 | 6/1994 | Fitch et al. | 174/88 R |
| 5,547,399 | 8/1996 | Naghi et al. | 439/623 |
| 5,726,388 | 3/1998 | Ferland | 174/72 A |
| 5,792,986 | 8/1998 | Lee | 174/72 A |
| 5,836,789 | 11/1998 | Kourimsky et al. | 439/604 |

*Primary Examiner*—Paula Bradley
*Assistant Examiner*—Ross Gushi
*Attorney, Agent, or Firm*—La Riviere, Grubman & Payne, LLP

[57] ABSTRACT

An electrical cable includes an insulated electrical conductor having first and second ends. At least one coupler is attached to the insulated electrical conductor between the first and second ends. The coupler includes a body having first and second surfaces. The first surface has a groove defined therein for coupling the cable to a complimentary shaped raised rib, and the second surface has a raised rib located thereon for coupling the cable to a surface defining a complimentary shaped groove.

23 Claims, 3 Drawing Sheets

ELECTRICAL CABLE INCLUDING STACKABLE COUPLERS

TECHNICAL FIELD

The present invention relates to an electrical cable including at least one coupler which is attached or attachable to the electrical cable. The coupler permits the cable to be attached to itself or to adjacent cables, thereby to provide a neater and more organized interconnection of electrical devices.

BACKGROUND OF THE INVENTION

The interconnection of electrical devices, such as the components of audiovisual systems, has often been a minor headache for the purchasers of such equipment. Often, a significant number of terminals are to be connected, which is confusing to the purchaser, and the resulting plethora of cables is unsightly.

One existing way of dealing with this problem has been through the use of cable ties which are used to group a series of cables together. The use of such cable ties is not particularly efficient, and the cable ties generally need to be cut in order to rearrange the cables.

Accordingly, there is a need for a convenient means of arranging cables. This is particularly true in the home entertainment field, where more and more audio and video components are interconnected to form integrated home entertainment systems.

SUMMARY OF THE INVENTION

According to the invention there is provided an electrical cable comprising:

an insulated electrical conductor having first and second ends;

a first coupler attached to the insulated electrical conductor between the first and second ends, the first coupler including a body having first and second surfaces, the first surface defining first engaging means; and a second coupler attached to the electrical conductor between the first and second ends and being spaced apart from the first coupler, the second coupler including a body having first and second surfaces, the second surface of the second coupler defining second engaging means for cooperative interlocking engagement with the first engaging means.

Preferably, the first engaging means comprises a groove defined in the first surface of the first coupler and the second engaging means comprises a raised rib shaped for engagement with the groove.

Also according to the invention there is provided an electrical cable comprising:

an insulated electrical conductor having first and second ends; and a coupler attached to the insulated electrical conductor, the coupler including a body having first and second surfaces, the first surface having a groove defined therein for coupling the cable to a complimentary shaped raised rib, and the second surface having a raised rib located thereon for coupling the cable to a surface defining a complimentary shaped groove.

Further according to the invention there is provided a coupler for use in attaching an electrical cable to another electrical cable or to a substrate, the coupler comprising:

a body having first and second surfaces, the first surface having a groove defined therein for coupling the body to a complimentary shaped raised rib, and the second surface having a raised rib located thereon for coupling the body to a surface defining a complimentary shaped groove; and means for attaching the body to a cable.

Preferably the means for attaching the body to a cable comprises at least one passage defined in the body of the coupler.

Other features of the invention are disclosed or apparent in the section entitled "BEST MODE OF CARRYING OUT THE INVENTION"

BRIEF DESCRIPTION OF THE DRAWINGS

For fuller understanding of the present invention, reference is made to the accompanying drawings in the following detailed description of the Best Mode of Carrying Out the Invention. In the drawings.

BEST MODE OF CARRYING OUT THE INVENTION

As electrical cables, connectors and conductors are well-known in the art, in order to avoid confusion, while enabling those skilled in the art to practice the claimed invention, this specification omits many details with respect to known items.

Figure 1:
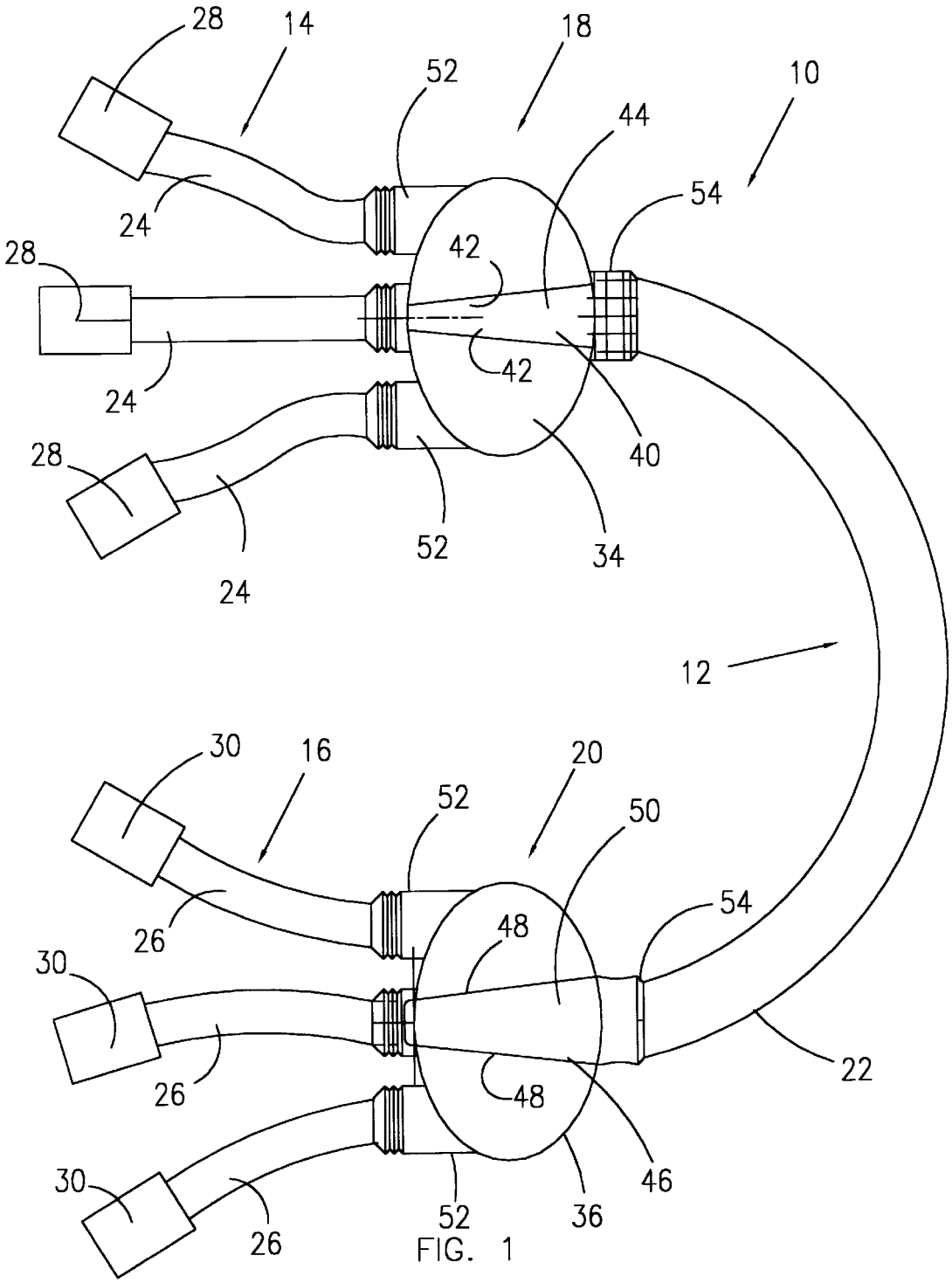
FIG. 1 is a plan view of an electrical cable incorporating couplers according to the invention.

An electrical cable according to the invention, generally indicated by the numeral 10, is shown in FIG. 1. The electrical cable 10 comprises a middle cable portion 12, first and second end cable portions 14 and 16, and first and second couplers 18 and 20.

The middle cable portion 12 comprises six separate electrical conductors contained in an insulating sheath 22. The sheath 22 terminates at each end of the middle cable portion 12 at the couplers 18, 20, while the six electrical conductors pass through the couplers 18, 20 to the end cable portions 14, 16.

The couplers 18, 20 are made of polyvinyl chloride (PVC) and are molded onto the cable portions 12, 14 and 16.. The couplers 18, 20 define manifold-like passages therein, to permit the six electrical conductors to be split into three groups of two as they pass through the couplers from the middle cable portion 12 to the end cable portions 14, 16.

The end cable portion 14 and the end cable portion 16 each comprise three insulating sheaths 24 and 26 respectively. Each insulating sheath 24, 26 contains two of the six electrical conductors that have passed through the couplers 18, 20 from the cable middle portion 12.

Each of the cable end portions 18, 20 terminate in an RCA electrical connector 28, 30 which have been illustrated schematically in FIG. 1. Each of the electrical connectors 28, 30 are electrically coupled to the two electrical conductors contained in the respective insulating sheaths 24, 26. The electrical connectors 28, 30 are marked, by means of color coded bands formed around each electrical connector 28, 30, to identify which electrical connector 30 at the first end 14 corresponds to which electrical connector 28 at the second end 16.

The electrical cable 10 may thus be used for interconnecting electrical equipment by plugging the relevant electrical connectors 28, 30 into the appropriate terminals on the electrical equipment.

The coupler 18 and the coupler 20 shown in FIG. 1 are structurally identical. Accordingly, for purposes of conciseness, common reference numerals will be used to describe both couplers 18, 20. It should however be noted that, as illustrated in FIG. 1, the coupler 18 is inverted with respect to the coupler 20 about the longitudinal axis of the cable middle portion 12.

Referring now to FIGS. 1 to 5, each coupler 18, 20 is generally elliptical in shape and comprises a body having a first surface 34, a second surface 36, and side surfaces 38 between the first and second surfaces 34, 36.

Defined in the first surface 34 is a first engaging means in the form of a groove 40. The groove 40 is defined by two sidewalls 42 and a floor 44 formed in the first surface 34. As can be seen in FIG. 1, the sidewalls 42 converge along the length of the groove 40. The total angle formed between the sidewalls 42 along the length of the groove 40 is an acute angle of approximately 18°.

Figure 2:
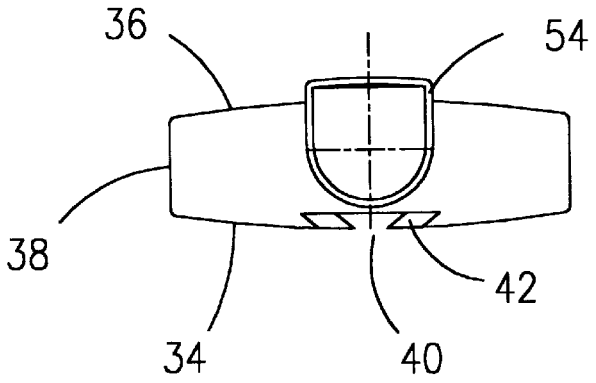
FIG. 2 is an end view of one of the couplers illustrated in FIG. 1.
Figure 3:
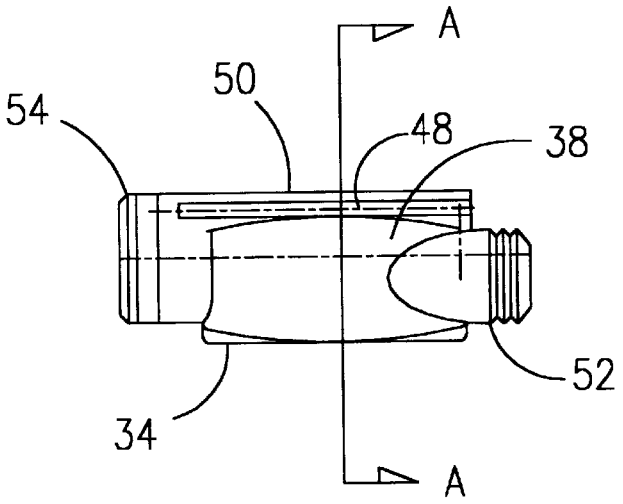
FIG. 3 is a side view of the coupler illustrated in FIG. 2.
Figure 4:
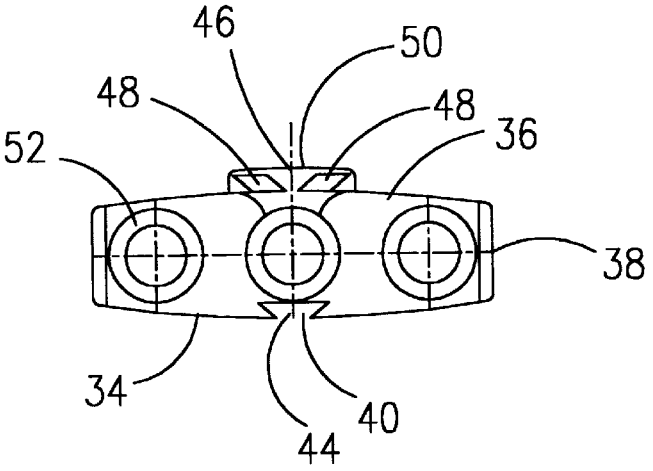
FIG. 4 is a view of the other end of the coupler illustrated in FIG. 2.
Figure 5:
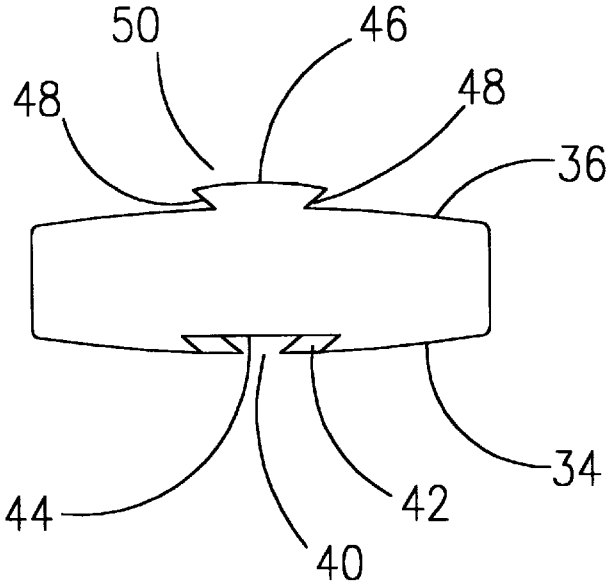
FIG. 5 is a transverse cross sectional view of the coupler of FIG. 2 taken along plane A—A in FIG. 3.

Also, as can be seen from FIGS. 2, 4 and 5, the sidewalls 42 are angled with respect to the floor 44 and with respect to each other, when viewed in transverse cross section of the groove 40. The angle formed between each sidewall 42 and the floor 44 in cross section is an acute angle of approximately 48°, and the angle of the sidewalls 42 with respect to each other in cross section is therefor approximately 96°. This angling of the sidewalls 42 relative to each other and to the floor 44 has the effect of defining an undercut in the groove 40.

Formed on the second surface 36 of each coupler 18, 20 is a second engaging means in the form of a raised rib 46, which is shaped for cooperative interlocking engagement with the groove 40 of the other coupler.

The rib 46 has two sidewalls 48 and an upper surface 50. As can be seen in FIG. 1, the sidewalls 48 converge along the length of the rib 46. The angle formed between the sidewalls 48 along the length of the rib 46 is selected to provide wedging engagement between the rib 46 of one coupler 18, 20 and the sidewalls 42 of the groove 40 of the other coupler 20, 18 as discussed below. Accordingly, in the illustrated embodiment, the sidewalls 48 converge along the length of the rib 46 at an acute angle of approximately 18°.

Also, as can be seen from FIGS. 2, 4 and 5, the sidewalls 48 are angled with respect to each other and with respect to the upper surface 36, when viewed in transverse cross section of the rib 46. Thus, the rib 46 is generally trapezoidal or dovetail in cross section. The angle formed between each sidewall 48 and a tangent to the surface 36, at the point of intersection of each sidewall 48 with the surface 36, is an acute angle of approximately 45°, and the angle of the sidewalls 48 with respect to each other, in cross section, is approximately 90°. This angling of the sidewalls 48 relative to each other and to the second surface 36 has the effect of forming transverse projections on the rib 46, which are shaped for interlocking engagement with the undercut of the sidewalls 42 defining the groove 40.

Extending from the body of each coupler 18, 20 are three corrugated boots 52 which support the insulating sheaths 24, 26 as they terminate in the couplers 18, 20. The boots 52 thus also serve to support the electrical conductors as they pass through from the insulating sheaths 24, 26 into the couplers 18, 20.

At the other end of each coupler 18, 20 is a larger boot 54 which supports the ends of the middle cable portion 12 where it terminates at the couplers 18, 20. As with the boots 52, the larger boot 54 provides support for the electrical conductors contained in the insulating sheath 22 as they pass from the middle cable portion 12 into the bodies of the couplers 18, 20.

Figure 6:
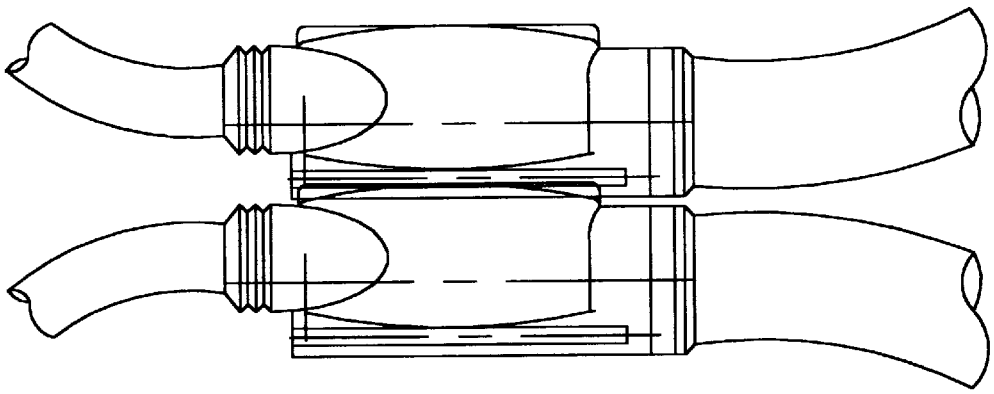
FIG. 6 is a partial side view of the electrical cable of FIG. 1 illustrating the couplers in an interlocking configuration.

In use, the user of the cable 10 bends the it in half so that the relatively narrower portion of the raised rib 46 of the one coupler, for example 18, is adjacent to the relatively wider portion of the groove 40 of the other coupler 20. The couplers 18, 20 are then moved relative to each so that the raised rib 46 slides into interlocking engagement with the sidewalls 42 defining the groove 40. This results in the stacked configuration illustrated in FIG. 6.

The interlocking engagement described above is maintained in a secure manner as a result firstly, because, when the rib 46 is slid into the groove 40, the sidewalls 48 wedge into engagement with the sidewalls 42. This is as a result of the taper of the sidewalls 48 along the length of the rib 46 interacting with the taper of the sidewalls 42 along the length of the groove 40. This wedging action provides a frictional force which is sufficient to prevent the couplers 18, 20 from sliding apart under normal conditions, but which can easily be overcome by a user pulling the couplers 18, 20 apart along the length of the groove 40.

Secondly, the transverse projections of the raised rib 46 interlock with the undercut in the groove 40 defined by the angled sidewalls 42. This prevents the one coupler 18 from lifting directly off the other coupler 20 when they are in the stacked configuration illustrated in FIG. 6.

This configuration provides a neat and convenient arrangement of electrical wiring. The couplers 18, 20 can easily be disengaged from each other, and many other configurations are possible.

The couplers of more than one cable 10 may also be interlocked in a number of different ways. For example, two cables 10 in the configuration illustrated in FIG. 6 may be stacked one on top of the other. Alternatively, the couplers 18, 20 of a single cable 10 may not be attached to each other at all, but may be attached only to the couplers of other cables 10. The particular configuration used will of course depend on the particular requirements of the electrical equipment to be interconnected.

It will be appreciated that the invention is not limited to the particular embodiment of the invention described above, and many modifications are possible without departing from the spirit and the scope of the invention.

For example, while in the best mode embodiment illustrated in the Figures, each coupler 18, 20 has a raised rib 46 as well as a groove 40 formed therein for purposes of ease of use, it will be appreciated that only one raised rib 46 may be provided on one coupler, with only one groove 40 defined in the other coupler.

Also, more or less electrical conductors, boots 52, insulating sheaths 24, 26 and electrical connectors 28, 30 may be provided, while more than one insulating sheath 22 may be provided in the middle cable portion 12.

Finally, it should also be noted that the particular electrical connectors 28, 30, and the particular electrical conductors used in the cable 10 do not form part of the inventive concept, but are preferably high end audio/video connectors and conductors designed and configured in accordance with known signal transmission practice and principles.

What is claimed is:

1. An electrical cable comprising:

an insulated electrical conductor having first and second ends;

a first coupler attached to the insulated electrical conductor between the first and second ends, the first coupler including a body having first and second surfaces, the first surface defining first engaging means; and a second coupler attached to the electrical conductor between the first and second ends and being spaced apart from the first coupler, the second coupler including a body having first and second surfaces, the second surface of the second coupler defining second engaging means for cooperative engagement with the first engaging means.

2. An electrical cable according to claim 1 wherein the first engaging means comprises a groove defined in the first surface of the first coupler, and the second engaging means comprises a raised rib shaped for cooperative engagement with the groove.

3. An electrical cable according to claim 2 wherein the groove is defined by two sidewalls and a floor formed in the first surface of the first coupler, and the sidewalls converge along the length of the groove, and the raised rib is tapered along its length for cooperative mating engagement with the sidewalls defining the groove, whereby the raised rib may be slid into wedging engagement with the sidewalls defining the groove.

4. An electrical cable according to claim 2 wherein the groove is defined by two sidewalls and a floor formed in the first surface of the first coupler, and the sidewalls define an undercut in the groove, and the raised rib has transverse projections shaped for interlocking engagement with the sidewalls defining the undercut.

5. An electrical cable according to claim 3 wherein the sidewalls define an undercut in the groove, and the raised rib has transverse projections shaped for interlocking engagement with the sidewalls defining the undercut.

6. An electrical cable according to claim 5 wherein the sidewalls defining the undercut are at an acute angle to the floor of the groove, and the raised rib is generally trapezoidal in cross section for interlocking engagement with the sidewalls.

7. An electrical cable according to claim 4 wherein the electrical cable comprises a plurality of electrical conductors, the plurality of electrical conductors being enclosed in a single outer insulating sheath between the first and second couplers and being enclosed in a plurality of separate outer insulating sheaths between the first coupler and an end of the cable.

8. An electrical cable according to claim 7 wherein the plurality of electrical conductors are enclosed in a plurality of separate outer insulating sheaths between the second coupler and an end of the cable.

9. An electrical cable comprising:

a middle cable portion, a first end cable portion and a second end cable portion;

a first coupler mounted between the middle cable portion and the first end cable portion, the first coupler including a body having first and second surfaces, the first surface defining first engaging means; and a second coupler mounted between the middle cable portion and the second end cable portion, the second coupler including a body having first and second surfaces, the second surface of the second coupler defining second engaging means for cooperative engagement with the first engaging means.

10. An electrical cable according to claim 9 wherein the cable includes a plurality of electrical conductors passing through the first cable end portion, the middle cable portion and the second cable end portion, the plurality of electrical conductors being contained in a single outer insulating sheath in the middle cable portion and being contained in a plurality of outer insulating sheaths in the first cable end portion.

11. An electrical cable according to claim 10 wherein the plurality of electrical conductors are contained in a plurality of outer insulating sheaths in the second cable end portion.

12. An electrical cable according to claim 11 wherein the first engaging means comprises a groove defined in the first surface of the first coupler, and the second engaging means comprises a raised rib shaped for engagement with the groove.

13. An electrical cable according to claim 12 wherein the second coupler further comprises a groove defined by the first surface of the second coupler, and the first coupler further comprises a raised rib formed on the second surface of the first coupler, the raised rib of the first coupler being shaped for cooperative engagement with the groove defined in the second coupler.

14. An electrical cable comprising:

an insulated electrical conductor having first and second ends; and a coupler attached to the insulated electrical conductor, the coupler including a body having first and second surfaces, the first surface having a groove defined therein for coupling the cable to a complimentary shaped raised rib, and the second surface having a raised rib located thereon for coupling the cable to a surface defining a complimentary shaped groove.

15. The electrical cable according to claim 14, further comprising:

a second coupler attached to the second end of the insulated electrical conductor, the second coupler including a body having first and second surfaces, the first surface having a groove defined therein for coupling to the raised rib of the coupler, and the second surface having a raised rib located thereon for coupling to the groove of the coupler.

16. The electrical cable according to claim 15, further comprising:

a first boot extending between the first end of the insulated electrical conductor and a first end of the coupler;

a second boot extending from a second end of the coupler opposite from the first end of the coupler;

a third boot extending between the second end of the insulated electrical conductor and a first end of the second coupler; and a fourth boot extending from a second end of the second coupler opposite from the first end of the second coupler.

17. The electrical cable according to claim 16, further comprising:

a fifth boot extending from the second end of the coupler; and a sixth boot extending from the second end of the second coupler.

18. The electrical cable according to claim 17 wherein the second, fourth, fifth, and sixth boots are corrugated.

19. A coupler for use in attaching an electrical cable to another electrical cable or to a substrate, the coupler comprising:

a body having first and second surfaces, the first surface having a groove defined therein for coupling the body to a complimentary shaped raised rib, and the second surface having a raised rib located thereon for coupling the body to a surface defining a complimentary shaped groove.

20. The coupler according to claim 19, further comprising:

a first boot extending from a first end of the body, wherein the first boot extends from the body to a first cable; and a second boot extending from a second end of the body opposite from the first end of the body.

21. A coupler according to claim 20 wherein the groove in the coupler is defined by two sidewalls and a floor formed in the first surface, and the sidewalls converge along the length of the groove, and the raised rib of the coupler is tapered along its length.

22. A coupler according to claim 21 wherein the sidewalls define an undercut in the groove formed in the coupler, and the raised rib of the coupler is formed with transverse projections.

23. A coupler according to claim 22 wherein the sidewalls defining the undercut are at an acute angle to the floor of the groove formed in the coupler, and the raised rib of the coupler is generally trapezoidal in cross section.

* * * * *